US005282415A

United States Patent [19]

Konermann

[11] Patent Number: 5,282,415

[45] Date of Patent: Feb. 1, 1994

[54] DEVICE FOR SUPPORTING A PRESSURE ROLL

[75] Inventor: Herbert Konermann, Lengerich, Fed. Rep. of Germany

[73] Assignees: Windmoller & Holscher, Lengerich; Du Pont de Nemours (Deutschland) GmbH, Bad Homburg, both of Fed. Rep. of Germany

[21] Appl. No.: 735,529

[22] Filed: Jul. 26, 1991

[30] Foreign Application Priority Data

Jul. 27, 1990 [DE] Fed. Rep. of Germany ..... 4023944

[51] Int. Cl.[5] ..... B30B 3/04

[52] U.S. Cl. ..... 100/160; 100/172; 100/173; 156/540

[58] Field of Search ..... 100/160, 168, 173, 172; 156/230, 235, 238, 241, 540

[56] References Cited

U.S. PATENT DOCUMENTS

| | | | |
|---|---|---|---|
| 864,660 | 8/1907 | Love | 100/160 |
| 2,718,827 | 9/1955 | Whittum . | |
| 2,825,671 | 3/1958 | Langhart et al. | 100/173 X |
| 3,736,869 | 6/1973 | Motter et al. . | |
| 4,484,970 | 11/1984 | Burzlaff et al. | 156/235 X |
| 4,586,978 | 5/1986 | Kondo et al. | 156/540 |
| 4,861,409 | 8/1989 | Hashida et al. | 100/173 X |

FOREIGN PATENT DOCUMENTS

| | | | |
|---|---|---|---|
| 201534 | 4/1956 | Australia | 100/173 |
| 1111003 | 7/1961 | Fed. Rep. of Germany . | |
| 1111813 | 7/1961 | Fed. Rep. of Germany | 100/173 |
| 4018295 | 12/1991 | Fed. Rep. of Germany . | |
| 2214008 | 8/1974 | France . | |
| 63-64726 | 3/1988 | Japan | 100/160 |
| 63-306088 | 12/1988 | Japan | 156/235 |
| 378600 | 7/1964 | Switzerland . | |

*Primary Examiner*—Stephen F. Gerrity

[57] ABSTRACT

This invention relates to an apparatus including pairs of rollers for supporting pressure rolls in a laminating apparatus. The rollers provide the pressure rolls with a uniform pressure distribution across the width of the pressure roll nip.

3 Claims, 2 Drawing Sheets

DEVICE FOR SUPPORTING A PRESSURE ROLL

FIELD OF THE INVENTION

This invention concerns a device for supporting a laminating pressure roll pair, in apparatus for color proofing a multi color print the apparatus, consisting of a pair of rolls which are assembled in a rack and which are separable from each other through whose gap an image-bearing element consisting of a support with an exposed layer having imagewise tacky and non-tacky areas and a colored film placed on top of the exposed layer, which colored film consists of a base film with a dye coating, are transported such that portions of the dye layer adhere to the tacky areas of the image bearing element.

BACKGROUND OF THE INVENTION

Pressure rolls, particularly those constituting the pair of rolls of a laminating press, are subject to the problem that flat sheets or webs which are carried below a roll or through the gap between rolls are not subjected to a uniform pressure across their entire width, even if the roll or rolls are supported by counterpressure rolls or support rolls, because these rolls or their supports are subject to bending. A device for the purpose of making color proofs of multi-color prints is disclosed in U.S. application Ser. No. 07/700,699 filed May 16, 1991 (U.S. Pat. No. 5,168,752) corresponding to German Pat. Appln. P 40 18 295.9. In this device pressure rolls which constitute the pair of rolls of a laminating press, do not apply a uniform pressure across the entire width of the image-bearing element having a colored film on top, when the element and film are transported through the pressure rolls. The non-uniform pressure across the width is because the supports for the laminating pressure rolls, which are positioned against the upper pressure roll and brace the lower pressure roll with a counter-pressure roll, are subject to bending. Thus, the line pressure in the areas near the ends of the gap between pressure rolls is greater than in the middle. The carrier of the upper support rolls is capable of bending because the spindles which raise and lower the pressure roll act on its slides.

It is therefore the object of this invention to provide a bracing device of the aforementioned kind, which assures that a flat object which is transported under the supported roll is subject to an essentially uniform pressure over its entire width.

SUMMARY

In accordance with this invention there is provided a device for supporting a laminating pressure roll pair. Preferably the device is used for color proofing a multi-color print and consists of a pair of rolls which are assembled in a rack and which are separable from each other, through whose gap an image-bearing element consisting of a support with an exposed layer having imagewise tacky and non-tacky areas and a colored film placed on top of the exposed layer, which colored film consists of a base film with a dye coating, are transported such that portions of the dye layer adhere to the tacky areas of the image-bearing element. The device is characterized by the fact that two supporting rolls are assembled at a distance from each other on a roll carrier which is located in the middle between the support rolls and lies, like a balance-strut, around an axis of rotation of the support rolls, at right angles to their rotational axis, on a support or a supporting piece which is either held in a fixed position or is fixed with respect to the frame.

BRIEF DESCRIPTION OF THE DRAWINGS

An embodiment of this invention is subsequently described in greater detail by means of a drawing of a color proofing device for multi-color prints, wherein.

DETAILED DESCRIPTION OF THE INVENTION

The object of the invention is accomplished by means of a device in which two support rolls are assembled at a distance from each other on a roll carrier. The roll carrier is located between the support rolls and lies, like a base strut around an axis of rotation perpendicular to the rotational axis of the roll, on a support or a supporting piece which is either held in a fixed position or is itself fixed with respect to the frame. The balance-strut-like positioning of the roll carrier guarantees that the rolls which are placed on it always support the laminating roll with the same force, so that any bending of the roll is prevented or is at least considerably inhibited.

If the device of this invention is used to brace both of the printing rolls of a device for color proofing multi-color prints, then the image-bearing element carrying a colored film on top is then the image-bearing element carrying a colored film on top is subjected to a somewhat more uniform pressure as it is transported through the gap between the pair of laminating rolls, so that a good image, which is not adulterated due to pressure differences, is obtained. The roll or rolls which are to be supported are supported along their length by several pairs of roll carriers.

In another embodiment of this invention, two roll carriers at a time are assembled to an additional balance-strut-like support which is positioned in the middle, between the two bearings of the roll supports, around an axis of rotation perpendicular to the rotational axis of the rolls, on a support or a supporting piece which is fixed to the frame or is held in a fixed position with respect to the frame. By means of this double balance-beam-like assembly of four support rolls the supporting force can be reduced to a single point located on a particularly stiffened support piece. If several balance-strut-like supports are provided, each for one pair of roll carriers, then their positions can be selected such that they are subjected to roughly equal supporting forces, so that all of the support rolls can be held against the roll or rolls which are to be supported with a uniformly distributed force.

The roll carriers and, if needed, their balance-strut-like supports are arranged symmetrically with respect to the center cross-sectional plane of the roll which is to be supported, so that this symmetry will also provide approximately uniform supporting forces to the supporting rolls.

Figure 1:
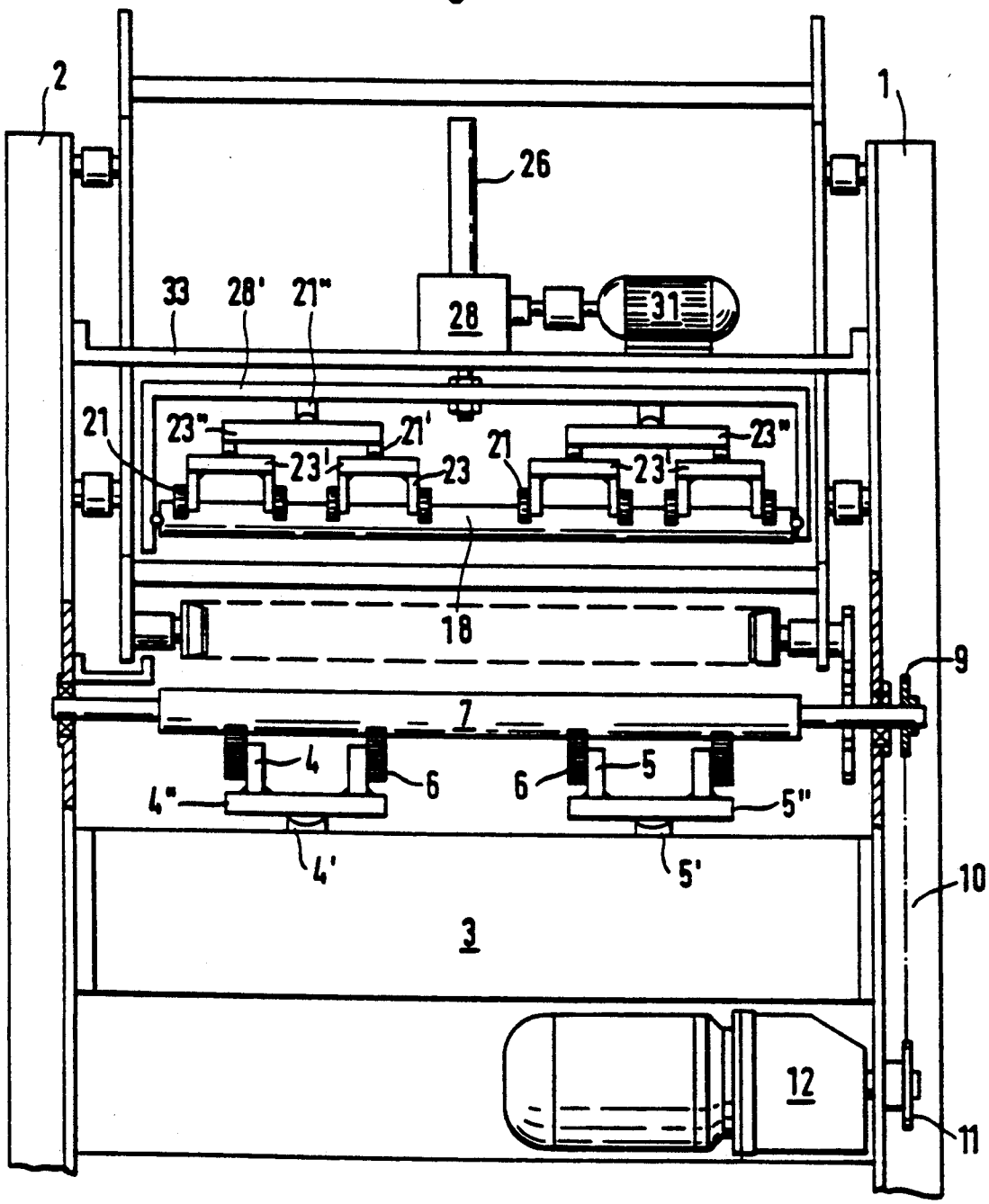
FIG. 1 is a front view of the device for proofing the color separations of a multi-colored print.
Figure 2:
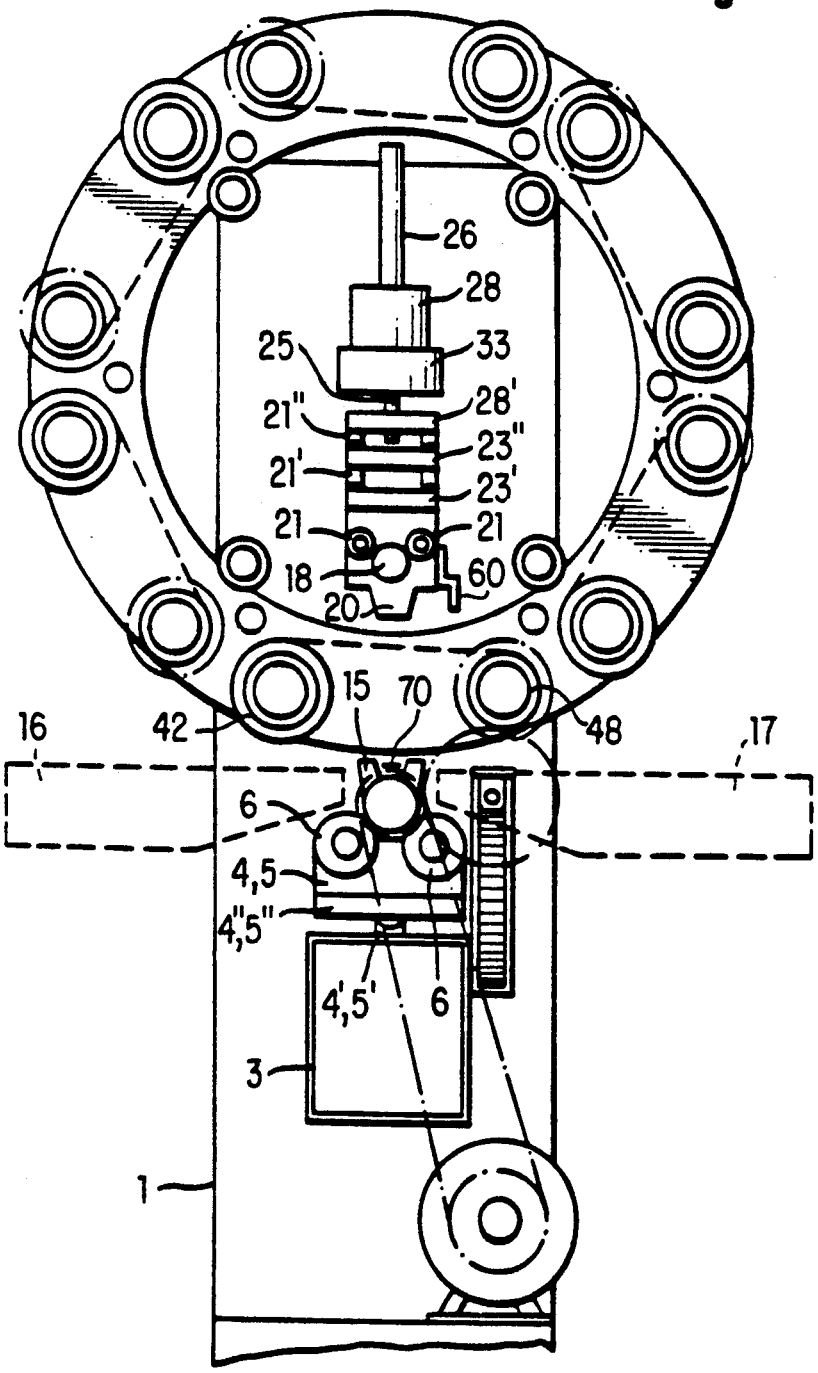
FIG. 2 is a center cross-section through the device.

A device suitable for the purpose of making color proofs of multi-color prints is shown in FIGS. 1 and 2 and is disclosed more fully in U.S. application Ser. No. 07/700,699 filed May 16, 1991 (U.S. Pat. No. 5,168,752) the disclosure of which is hereby incorporated by reference. Only the aspects of the device pertaining to the present invention will therefore be described herein in detail.

The machine frame consists of two sidewalls, 1 and 2, which are firmly interconnected through a strut, 3. Bearing housings, 4' and 5', are welded to the strut, 3. The bearing housings, 4' and 5', carry the roll carriers, 4'' and 5'' on cylindrical shell-shaped bearings, which in turn, hold the bearing housings, 4 and 5, for the support rollers, 6. The support rollers, 6, cradle a pressure roll, 7, which is assembled to the two sidewalls 1 and 2, so that the pressure roll can be driven. To drive the pressure roll, 7, a trunnion journal is brought sideways out of the wall, 1, and carries a sprocket wheel, 9. The sprocket wheel, 9, is connected to a sprocket wheel, 11, on a drive motor, 12, through a chain, 10.

An upper pressure roll, 18, is braced by the support rollers, 21, which are supported by bearing housings, 23, located on roll carriers, 23', in a balance-strut-like manner. The roll carrier beams, 23', are supported via cylindrical shell-shaped bearings, 21', at the ends of additional carriers, 23'', which are also supported in a balance-strut-like manner. These balance-strut-like carriers, 23'', are in turn, located via additional cylindrical shell-shaped bearings, 21'', on the crosspiece of a stirrup-shaped carrier, 28'. The stirrup-shaped carrier, 28', can be raised and lowered through a spindle, 26, which traverses a drive housing, 28, when a motor, 31, is activated. The drive housing, 28, and motor, 31, are connected to a ledge, 33, which is firmly screwed to the sidewalls, 1 and 2.

FIG. 2 shows print roller 7, input table 16 and output table 17 which are used for the guidance of an image-bearing element 70. Upper press roller 18 is rotatably mounted and, when moved downward, projection 20, which tapers downwardly meshes with the correspondingly shaped cut-out 15 adjacent print roller 7. The purpose of the meshing of v-shaped projection with v-shaped cut-out 15 is to secure the upper press roller 18 against lateral migration during the pressure process.

If, across table 16, there is delivered an image-bearing element 70, press roller 18 is moved downwards by means of motor 31 and thereby presses a color foil, located between color foil roll 42 and empty coil 48, downwardly against print roller 7. Color foil 42 rolls off during traversing of the image-bearing element by contacting the image-bearing element so that color is transferred thereto. The process is repeated for transferring further colors to the image-bearing element 70. For clearly peeling a color foil ironed on an image bearing element, from the image-bearing element during the passage thereof through the roller gap, a peeling-off ledge 60 is firmly connected with bearing block 23. The color web on the image-bearing element is, for instance, pulled off, vertically upwards by ledge 60.

To lend additional stiffness to the support bearings of the roll carriers and the balance-strut-like carriers, they can be additionally braced or stiffened in the areas of the support bearings.

As in the above-noted prior U.S. patent application, a rotary structure including spaced wheels 60, mounts a plurality of colored films 62–72 for sequential transport through the gap between rolls 7 and 18 in superposed relation to an image carrier 70 also located in the gap so that the film colors can be printed on the image carrier by pressure exerted by the rolls.

I claim:

1. A device for supporting a pressure roll in an apparatus for color proofing a multicolor print comprising a frame, first and second pressure rolls mounted in the frame and defining a gap between said pressure rolls for applying laminating pressure to an image bearing element and a superposed colored film located within said gap, at least one of said first and second pressure rolls being moveable toward and away from the other of said pressure rolls for varying the gap, transporting means for moving the film to and through said gap, drive means for rotating at least one of said pressure rolls, and support means for at least one of said pressure rolls, said support means comprising a fixed elongated element mounted on said frame, a plurality of pairs of support rollers spaced lengthwise along the at least one of said pressure rolls, each pair of support rollers bracing the at least one of said pressure rolls therebetween, a plurality of roller carriers each roller carrier rotatably supporting two pairs of the support rollers, each said roller carrier comprising an elongated element extending parallel to an axis of rotation of the support rollers, and a plurality of bearing housings, each bearing housing mounting one of said roller carriers on said fixed elongated element.

2. Device as claimed in claim 1 wherein adjacent pairs of roller carriers are mounted on a common intermediate roller carrier and the intermediate roller carrier is mounted on the respective bearing housing.

3. Device as claimed in claim 1 wherein the transporting means for moving the film to and through said gap comprises a wheel structure rotatably mounted on the frame, and circumferentially spaced mounting means on the wheel structure for a plurality of colored films whereby the films can be moved sequentially through said gap.

* * * * *